US008899450B2

(12) United States Patent
Johansson et al.

(10) Patent No.: US 8,899,450 B2
(45) Date of Patent: Dec. 2, 2014

(54) BATTERY-POWERED DOSING DEVICE

(75) Inventors: Daniel L. Johansson, Enebyberg (SE); Per-Erik Pers, Jarfalla (SE)

(73) Assignee: Aktiebolaget Electrolux, Stockholm (SE)

( * ) Notice: Subject to any disclaimer, the term of this patent is extended or adjusted under 35 U.S.C. 154(b) by 51 days.

(21) Appl. No.: 13/698,378

(22) PCT Filed: May 17, 2011

(86) PCT No.: PCT/EP2011/057992
§ 371 (c)(1),
(2), (4) Date: Feb. 8, 2013

(87) PCT Pub. No.: WO2011/144628
PCT Pub. Date: Nov. 24, 2011

(65) Prior Publication Data

US 2013/0240570 A1 Sep. 19, 2013

(30) Foreign Application Priority Data

May 18, 2010 (SE) ..... 1000525

(51) Int. Cl.

| | |
|---|---|
| ***B67B 7/00*** | (2006.01) |
| ***G01F 11/00*** | (2006.01) |
| ***B65D 88/54*** | (2006.01) |
| ***B67D 7/58*** | (2010.01) |
| ***F04B 49/06*** | (2006.01) |
| ***F04B 13/00*** | (2006.01) |
| ***F04B 17/04*** | (2006.01) |

(52) U.S. Cl.
CPC ..... *F04B 13/00* (2013.01); *F04B 49/065* (2013.01); *F04B 2203/0401* (2013.01); *F04B 17/044* (2013.01)
USPC ..... 222/333; 222/1; 222/310; 222/375; 417/44.1; 417/44.11

(58) Field of Classification Search
USPC ..... 222/333, 282, 309, 310, 372, 14, 52, 222/63, 1; 417/44.1, 53, 44.11, 410.1, 415, 417/417, 45; 318/129, 135; 310/12.17, 14
See application file for complete search history.

(56) References Cited

U.S. PATENT DOCUMENTS 4,124,146 A * 11/1978 Sealfon ..... 222/641
4,278,959 A * 7/1981 Nishimiya et al. ..... 335/262
(Continued)

FOREIGN PATENT DOCUMENTS

GB 2103296 2/1983
WO 2007056097 5/2007

OTHER PUBLICATIONS

International Search Report for PCT/EP2011/057992, dated Sep. 28, 2011, 2 pages.

*Primary Examiner* — J. Casimer Jacyna
*Assistant Examiner* — Benjamin R Shaw
(74) *Attorney, Agent, or Firm* — Pearne & Gordon LLP

(57) ABSTRACT

Dosing device (100) for dispensing a specified vol" ume of liquid, comprising an electromagnet (1 11) and being adapted to hold a pump (1 12) with a magnetisable pumping member (1 10) displaceable under the action of the electromagnet when the pump is held by the dosing device. The dosing device further comprises a portable voltage source (1 13) adapted to energize the electromagnet by repeated current pulses and to measure the current intensity at least once per pulse, thereby estimating the charge amount in each pulse, until a total charge amount corresponding to the speci" fied volume of liquid to be dispensed has been supplied. A method including pulse-wise activation of an electromagnet actuating a pump having a magnetisable pumping member is also disclosed.

16 Claims, 3 Drawing Sheets

(56) References Cited

U.S. PATENT DOCUMENTS

| | | | | | |
|---|---|---|---|---|---|
| 4,496,292 | A * | 1/1985 | Panick et al. | 417/252 |
| RE32,783 | E * | 11/1988 | Clark | 335/261 |
| 4,994,984 | A * | 2/1991 | Massimo | 702/46 |
| 8,007,247 | B2 * | 8/2011 | Sarkinen et al. | 417/44.11 |
| 2004/0234377 | A1 * | 11/2004 | Bolt | 417/44.1 |
| 2007/0170212 | A1 * | 7/2007 | Biesheuvel | 222/333 |
| 2008/0001560 | A1 * | 1/2008 | Livoti | 318/129 |
| 2008/0294098 | A1 * | 11/2008 | Sarkinen et al. | 604/67 |
| 2010/0232992 | A1 * | 9/2010 | Gray | 417/417 |
| 2010/0322795 | A1 * | 12/2010 | Jones et al. | 417/415 |
| 2012/0321485 | A1 * | 12/2012 | Proietti De Marchis | 417/44.1 |

* cited by examiner

BATTERY-POWERED DOSING DEVICE

TECHNICAL FIELD

The invention disclosed herein generally relates to high-accuracy, magnetically actuated electric pumps. More precisely, it relates to a battery-powered dosing device including an electromagnet for actuating a pump and a method of operating such device.

BACKGROUND OF THE INVENTION

Several types of highly accurate liquid dosing devices are known in the art. A first type, which is commonly used in laboratory applications, is devices with step motor driven pumps. Dosing devices of a second type comprise small electric pumps, the pumping action of which is a result of the motion of a magnetisable internal pumping member, such as a ferromagnetic piston, causing a well-defined amount of liquid to be dispensed. Dosing devices of the second type may be embodied as low-cost pump units integrated in distribution containers for liquids and disposable together with these containers. Each pump unit may be actuated by means of an electromagnet arranged in a (non-disposable) structure for holding the liquid container. Such a dosing device, which is specially adapted for dispensing viscous liquids is known from GB 2 103 296 A, wherein a pumping chamber is defined by a flexible or resilient cylindrical chamber wall and non-return inlet and outlet valves. Pumping is effected by serial deformation of the pumping chamber by downward motion of a magnetisable circular element arranged at the top of the pumping chamber. Further, WO 2007/56097 A2 discloses a cartridge with a concentrate pumping device to be received by a dispenser. The dispenser is equipped with an electromagnet with a wound coil for acting on a piston slidably arranged in a dispensing tube in the pumping device, whereby the concentrate is forced out of the pumping device. Both of these, like other known dosing devices, are powered by electric mains.

Dosing devices of this nature would probably find more widespread use if powering by a portable voltage source, such as batteries, were available. For instance, it would be possible to increase the lifetime of a foodstuff liquid to be dispensed by storing and operating the dispenser in a refrigerator.

SUMMARY OF THE INVENTION

It is an object of the invention to provide a portable dosing device for dispensing an accurately metered volume of liquid and a method for operating such a device. It is a particular object to provide a battery-powered dosing device of this type.

The invention achieves this object by providing devices and methods having the characteristics defined by the independent claims. Embodiments of the invention are defined by the dependent claims.

In one aspect, the invention provides a method of dispensing a specified volume of liquid using a pump comprising a magnetisable pumping member displaceable under the action of an electromagnet energisable by a portable voltage source. The method comprises the steps of:

(i) defining a total charge amount ($Q_{tot}$) corresponding to the specified volume of liquid;

(ii) energising the electromagnet by connecting it to the voltage source during a pulse;

(iii) performing at least one current measurement ($I_{m,n}$) during the pulse and estimating, based thereon, the charge amount ($Q_m$) supplied; and (iv) repeating steps (ii) and (iii) until the total charge amount has been supplied.

In another aspect, the invention provides a dosing device adapted to dispense a specified volume of liquid. The dosing device comprises an electromagnet and is adapted to hold a pump (which may be removable or fixed) having a magnetisable pumping member, arranged in such manner that its reciprocating displacement causes liquid to be expelled from the pump, wherein the magnetisable pumping member is displaceable under the action of the electromagnet when the pump is held by the dosing device. The dosing device further comprises a portable voltage source adapted to energise the electromagnet by repeated current pulses, and to measure the current intensity at least once per pulse for thereby estimating the charge amount supplied in each pulse, until a total charge amount corresponding to the specified volume of liquid to be dispensed has been supplied.

The dosing device may have a recess adapted to receive the pump and/or holding means for retaining the pump. The holding means may be form-fitting mechanical elements, spring-loaded clamps, magnetic retention means, adhesive joints, a Velcro fastening and the like.

The pumping member may be embodied as a piston, as a combined valve member and piston, as an element for depressing or expanding a membrane or a (partially) flexible pumping chamber, as a hollow tube displaceable with respect to a fixed internal piston, as a (possibly hinged) bellow side, or as any other means for converting linear and/or rotary motion into displacement of liquid. The pumping member contains at least one magnetisable material (such as iron, cobalt, nickel and other ferromagnetic materials, including some metal oxides), and will therefore interact with an external magnetic field. It is well known in the art that contactless mechanical interaction between an active electromagnet and a body of magnetisable material is possible. The pumping member is preferably biased, e.g., by a linear spring, torsion spring, shim, elastomeric body or other resilient member. This affords the pump a simpler structure insofar as the electromagnet is only used for displacing the pumping member in one direction. For instance, the electromagnet may comprise a wound coil (solenoid), possibly equipped with a ferromagnetic core, which will generate a substantially uniform magnetic field in the neighbourhood of its longitudinal axis when energised by a direct current. It is well known that the local magnetic flux at a given point is proportional to the current generating the field. Therefore, in this model, the magnetic force exerted on the pumping member is proportional to the current.

For the purpose of this disclosure, a pulse is a limited time period during which the electromagnet is energised by a current so that a magnetic field arises and actuates the pumping member. Preferably, two pulses are separated by an interval allowing the pumping member to return to its original position. Moreover, if a chemical voltage source is used, the interval will allow some time for the realization of reactions which to some extent re-establish the original electric characteristics of the voltage source.

The portable voltage source may comprise a chemical voltage source such as a battery or an assembly of batteries, each being rechargeable or non-rechargeable. The portable voltage source may also be a fuel cell. In comparison with an ideal voltage source, batteries have two characteristic properties:

1. The output voltage decreases with the momentary current drawn from the battery; this behaviour is commonly modelled by the presence of an internal resistance.
2. The output voltage decreases with time when a constant load is applied to the battery, especially a relatively heavy load. For a fresh battery, the output voltage may re-establish to its original value in finite time after the load is removed or reduced. The battery will recover more and more slowly with ageing.

The inventors have realised that these properties pose a difficulty in the design of a battery-powered, magnetically actuated dosing device because the required electromagnet current cannot always be attained or maintained throughout each pumping cycle. The accuracy of a hypothetical dosing device, wherein the electric mains supply in a prior-art device were replaced by a battery in the straightforward manner, would be likely to have poor accuracy. Indeed, the time-variable characteristics of a battery would make it uncertain as to whether the pumping member had completed its full work cycle and thereby displaced the design (or nominal) volume of liquid. In the case of a piston pump, for instance, it would be uncertain whether the piston had travelled its full stroke back and forth and thus expelled the design volume of liquid.

The invention achieves its particular object of enabling dispensing of an accurately metered volume by virtue of the current measurement(s) carried out during each work pulse of the electromagnet. The measured current values are used for estimating a charge amount supplied to the electromagnet in each work pulse. It has been established that the pumping of a given volume of liquid entails supplying a computable charge amount to the electromagnet. Thus, while computing and monitoring the accumulated charge amount, the pulse-wise pumping is carried on until a prescribed total charge amount has been supplied. The total charge amount is computed as a function of the specified volume of liquid to be dispensed and allows adequate control of the dosing device. Hence, the invention also achieves its object of providing a portable dosing device, because no electric mains powering is necessary and all other parts of the device can be embodied so that they form an easily transportable unit.

Expressed in formulas, the method according to the invention initially computes a total charge amount $Q_{tot}$ as a function of the total volume $V_{tot}$ to be dispensed, $Q_{tot}=Q_{tot}(V_{tot})$. At least one current value is measured in each pulse. In the $m^{th}$ pulse, n current values $I_{m,1}, I_{m,2}, \ldots, I_{m,n}$ are recorded and form the basis for estimating a charge amount $Q_m$ supplied to the electromagnet during the $m^{th}$ pulse. For instance, one may estimate the charge amount by the mean current multiplied by the pulse length $T_m$, namely:

$$Q_m \approx \frac{T_m}{n}\sum_{l=1}^{n} I_{m,l}.$$

The accumulated charge amount after k pulses is given by:

$$Q = \sum_{m=1}^{k} Q_m,$$

and the pumping is discontinued as soon as $Q \geq Q_{tot}$.

In one embodiment, each pulse has a predefined maximum length $T_{max}$. This takes into account the second property of batteries mentioned above, namely, that the battery performs better when a load is applied in relatively short load pulses. This mode of operation is also preferable from the point of view of long-term battery fatigue. A suitable value of the predefined maximum pulse length can be determined by routine experimentation on a battery of the relevant type.

In one embodiment, a pulse is interrupted if a measured momentary current value is lower than a predefined minimum current $I_{min}$. The minimum current value may be determined by routine experimentation. This preserves the lifetime of a battery, as weak output current is a sign of fatigue. A fresh or slightly aged battery will resume normal electric properties before the next work pulse begins. On the other hand, repeated interruptions according to this criterion will indicate that a battery is seriously aged or defect and needs to be replaced. In particular, it is possible to combine the two criteria of maximum length $T_{max}$ and minimum momentary current $I_{m,n}$, whereby the latter criterion may interrupt the pulse prematurely, so that $T_m<T_{max}$.

In one embodiment, a pulse is interrupted if a predefined maximum per-pulse charge amount $Q_{max}$ has been supplied. For a particular combination of an electromagnet and a biased pumping member, the completion of a (first half of a) pumping cycle coincides with a certain charge amount having been supplied. In the particular case of a linearly movable pumping member, such as a piston, the completion of a pumping cycle corresponds to a full stroke. After this, the pumping member will travel back to its original position by virtue of the biasing. As there is no point in maintaining the actuating force after this point, which would waste energy without achieving any further displacement of the pumping member, it is energy-economical and battery-preserving to interrupt the pulse here. As a consequence of this control criterion, a volume of liquid that corresponds to a total charge amount $Q_{tot}>Q_{max}$ is necessarily dispensed by more than one pulse. It is noted that this control criterion may readily be combined with that of maximum pulse length $T_{max}$ and/or of minimum momentary current $I_{min}$.

In one embodiment, a least separation of consecutive pulses is observed. By allowing the battery an interval of at least $D_{min}$ time units to recover from the preceding load pulse, its useful life is extended. The battery may also perform better during the next pulse. Again, this control criterion can be combined to advantage with any of the above criteria.

In one embodiment, the accumulated charge Q is computed after each work pulse but not during work pulses. This means that the decision to interrupt the pumping process is taken after a complete work pulse.

In other embodiments, the accumulated charge Q is computed continuously by successively adding increments estimated on the basis of the current values yet obtained in a pulse. This provides for a more accurate dispensing, since the pumping can be interrupted inside a pulse.

In one embodiment, the total charge amount $Q_{tot}$ is computed using a linear numerical relation, so that $Q_{tot}=Q_{tot}(V_{tot})=K\times V_{tot}$, where K is a constant depending on the geometry of the pump, the properties of the electromagnet, the viscosity of the pumped liquid and related factors. However, K is assumed to be substantially independent of the properties of the voltage source, in particular of the actual level of fatigue of a battery comprised therein. It is adequate to operate a dosing device with the above characteristics on the basis of this linear relation between the charge amount and the dispensed volume. Indeed, assuming the pumped liquid to be incompressible and neglecting the kinetic inertia of the pumping member, it follows that a displacement of the pumping member will be opposed by a force substantially proportional to the velocity of the displacement. The opposing force is a result of internal friction, viscous forces, especially at narrow flow passages, displacement of liquid in the direction of the gravitational field or against resilient forces, etc. It follows from these assumptions that the momentary flow of liquid discharged from the pump is proportional to the force exerted by the electromagnet, which is in turn—assuming the magnetic field to be locally homogeneous along the displacement path of the magnetic member—is proportional to the momentary current, that is:

$$i(t) = K \times \frac{dV}{dt},$$

where i(t) is the momentary electromagnet current. By this relationship, the volume dispensed during a pulse is proportional to the charge amount supplied during the pulse. Integrating the relationship over the total time interval required for dispensing the total volume, one obtains $Q_{tot}=K\times V_{tot}$. The constant K is suitably determined by a calibration procedure in which the pump is operated during pulses of known length at known current intensity while measuring the resulting pumped volumes. It is remarked that the above derivation leading up to the linear relation between charge amount and dispensed volume has been made heuristically and under simplifying assumptions; nevertheless, its usefulness as a basis for controlling a dosing device is an empirical fact independent of more accurate relationships that may result from a more comprehensive analysis.

In one embodiment, the current measurements are performed at a sequence of equally or unequally spaced points in time in a later portion of each cycle. The measured values allow the output current to be estimated as a function of time. For instance, the voltage source may be connected to the electromagnet for a predetermined latency interval $T_{lat}$ before the sequence of current measurements are initiated. This is an economical way of operating the dosing device, as the initial current measurements are largely independent of the actual fatigue level of the battery and may be approximated by the initial current value of a fresh battery. The performance of the battery will usually become apparent only after the latency interval $T_{lat}$. It is understood that the latency interval is usually several times longer, and may be tens of times longer, than a typical interval separating two consecutive current measurements in a sequence of measurements.

In one embodiment, the invention provides a dispenser assembly for dosing liquid from several containers (pouches). The dispenser assembly is composed of a voltage source and at least one dispensing unit. Each dispensing unit comprises an electromagnet and a holder for receiving a liquid container having a pump arranged at its outlet. The pump has the structure of one of the embodiments set forth above and is actuated by the electromagnet in the same fashion. The voltage source is adapted to energise a selected one of the electromagnets in order to dispense liquid from the corresponding container. One voltage source may serve one electromagnet or several. If several voltage sources are provided, it is advantageous to embody at least a portion containing the battery or batteries in a shared fashion, so that it can be accessed by more than one voltage source.

Features from two or more embodiments outlined above can be combined, unless they are clearly complementary, in further embodiments. The fact that two features are recited in different claim does not preclude that they can be combined to advantage. Likewise, further embodiments can also be provided the omission of certain features that are not necessary or not essential for the desired purpose.

BRIEF DESCRIPTION OF THE DRAWINGS

Embodiments of the invention will now be described with reference to the accompanying drawings, on which.

DETAILED DESCRIPTION OF EMBODIMENTS

Figure 1A:
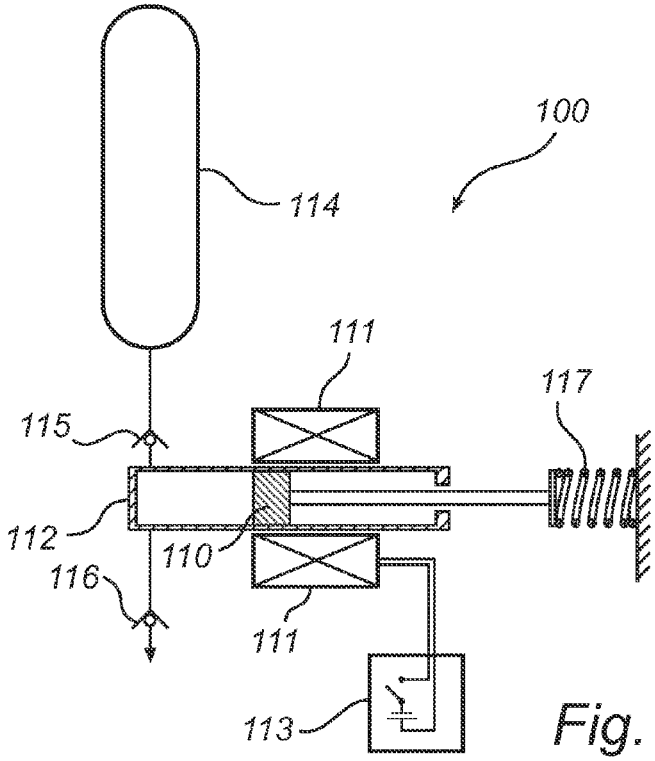
FIG. 1 shows (partially schematically) dosing devices according to three embodiments of the invention.

FIG. 1A is a schematic drawing of a dosing device 100 for dispensing an accurately metered volume of liquid from a container 114. The dosing device comprises a magnetisable piston 110 which is slidably arranged in a cylinder 112 and substantially liquid-tightly fitted therein. An electromagnet 111 is operable to create a magnetic field in the central region of the cylinder 112, that is, at all points of space where the piston 110 may be located. When the piston 110 moves to the right, liquid is drawn through an inlet check valve 115 into the left portion of the cylinder 112. When the piston 110 moves to the left, liquid is expelled from the cylinder 112 through an outlet check valve 116. During each movement, the piston 110 exchanges mechanical energy with a linear spring 117 attached to the piston 110. The other endpoint of the spring 117 is preferably attached to an element that is stationary in relation to the cylinder 112. Whether the spring receives energy on leftward movement and supplies it on rightward movement, or vice versa, depends on the relaxed position of the spring. The spring 117 may be preloaded by the provision of an abutment or a stop (not shown) limiting the relaxation of the spring, whereby a relatively more constant spring force is achieved.

The electromagnet 111 of this embodiment comprises a wound coil (not shown), at the centre of which a substantially homogeneous magnetic field arises when a current flows through the coil. The magnetic flux in this region varies linearly with the current intensity, the precise relationship being determined by the geometry of the coil and the characteristics of a magnetic core if such is provided. The electromagnet 111 is supplied with current from a voltage source 113, which is preferably designed as a portable unit and may contain a chemical voltage source, such as a rechargeable or non-rechargeable battery. As is well known, several chemical voltage sources can be connected in series to provide a greater output voltage, so that the electromagnet 111 will provide a magnetic field of suitable strength when driven. In this embodiment, the voltage source 113 is connected to and disconnected from the coil of the electromagnet 111 by means of a switch. The coil current may vary over time as a result of short-term and long-term fatigue of the voltage source 113, as discussed above in connection with batteries.

Figure 1B:
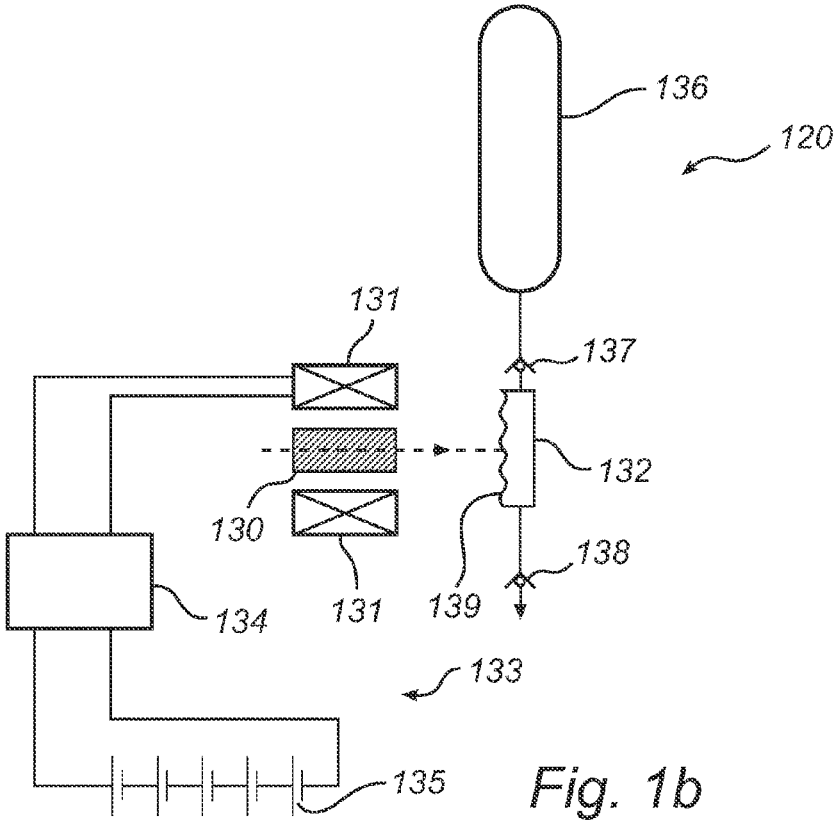

FIG. 1B shows a further dosing device 120 for dispensing a specified volume of liquid from a container 136. The device comprises a pumping chamber 132 having a flexible wall segment 139. The latter may be acted upon by a magnetisable pumping member 130, which can be displaced under the action of a magnetic field generated by means of the electromagnet 131. Liquid from the container 136 is drawn into the pumping chamber 132 through a first check valve 137 and is expelled, upon compression of the flexible wall 139, through a second check valve 138. The electromagnet 131 is energisable by a voltage source 133, which comprises five batteries 135 connected in series and a combined control unit and voltage booster 134. The combined control unit and voltage booster 134 is adapted, on the one hand, to establish the pulse-wise electric connection between the batteries 135 and the electromagnet 131 as set out above and, on the other hand, to increase the output battery voltage. Voltage boosting devices, with the general aim of delivering a high-voltage output on the basis of a low-voltage input, are well known in the art and may for instance consist of an inductance component arranged to be excited by a high-frequency oscillating current drawn from the low-voltage input. The high-voltage oscillating current is then smoothed into a high-voltage direct current. The combined control unit and voltage booster 134 in this embodiment includes the necessary circuitry for acting as a voltage boosting device in addition to its switching circuitry.

Figure 1C:
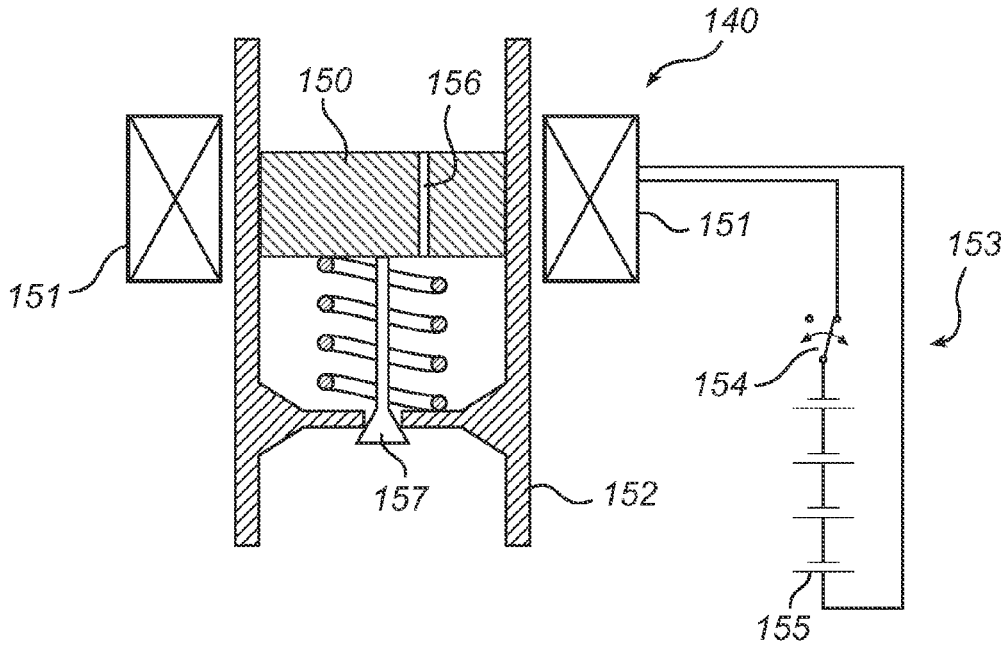

FIG. 1C shows a third dosing device 140 according to another embodiment of the invention. The pumping action of the dosing device 140 is furthered by gravity if it is operated in an upright position, the upward direction in the drawing approximately corresponding to the upward direction in the gravitational field. The dosing device 140 comprises a magnetisable piston 150, upstream of which a liquid to be pumped is located. The piston 150 cooperates with the inside wall of a pump cylinder 152 but is movable along this and spring-biased in the upward direction. The resting position of the piston 150 is defined by a seal head 157 abutting against a centrally arranged valve seat in the cylinder 152, whereby the upward mobility of the piston 150 is limited. Similarly to the previous embodiments, the piston 150 can be actuated through the medium of a magnetic field generated by an electromagnet 151 arranged in the region of the piston 150 and rigidly attached to the cylinder 152. Preferably, the action of the magnetic field is a downward force compressing the spring. The electromagnet 151 is supplied with current drawn from a set of serially coupled portable voltage sources 155, which are connectable to the electromagnet 151 by means of a switch 154. The switch 154 and the batteries 155 together form a voltage supply unit 153. In order to prevent hang-up and allow the biasing spring to push the piston 150 upward immediately after it reaches the bottom of the cylinder 152, at which the valve seat is provided, a narrow passage 156 is provided through the piston 150. The passage 156 allows the liquid to flow into the space downstream of the piston 150 during its upward movement. After the piston 150 has come off the bottom of the cylinder 152, liquid may also flow between the piston 150 and the vertical cylinder wall.

The three pumps shown so far include a pumping member that is biased, which however does not represent an essential feature of the invention. In some embodiments, there may be provided a non-biased pumping member, such as a freely movable piston not connected to a resilient element. The electromagnet is then responsible both for pushing the piston forth and for pulling it back. This solution is clearly energy-neutral in comparison with using a biased pumping member, but on the other hand requires the magnetic field produced by the electromagnet to have a slightly larger spatial extent, which may contribute to making the structure of the dosing device more complex in these embodiments.

The invention can be embodied in relation to other pump types than those appearing in the dosing devices shown in FIGS. 1A, 1B and 1C. For example, the pumps disclosed in the already cited references GB 2 103 296 A and WO 2007/56097 A2 may be operated in accordance with the teachings of the present invention.

The contemplated applications of the invention include domestic post-mix drink systems, such as flavoured waters prepared by dilution of syrups. Such syrups may contain flavouring agents, colorants and preservatives but also nutritional additives, such as vitamins and mineral nutrients, which are to be dosed in accurately controlled quantities. The present invention is particularly advantageous in connection with highly concentrated syrups indented to be diluted by 1:10 by volume, such as 1:100 or 1:250 or 1:1000 by volume. The volume of syrup necessary for a drinking glass or a pitcher may typically be 1.00 ml. Usually a relative error of 10% will lead to an appreciable change in taste or nutritional content, so that the maximal admissible absolute error is less than 0.10 ml. When used for dispensing a volume of this order, a dosing device according to the invention is advantageous in that it provides enough absolute accuracy to meet the requirements. Moreover, since the volume pumped is moderate, the portable voltage source driving the device will not be subject to any considerable fatigue.

Figure 2:
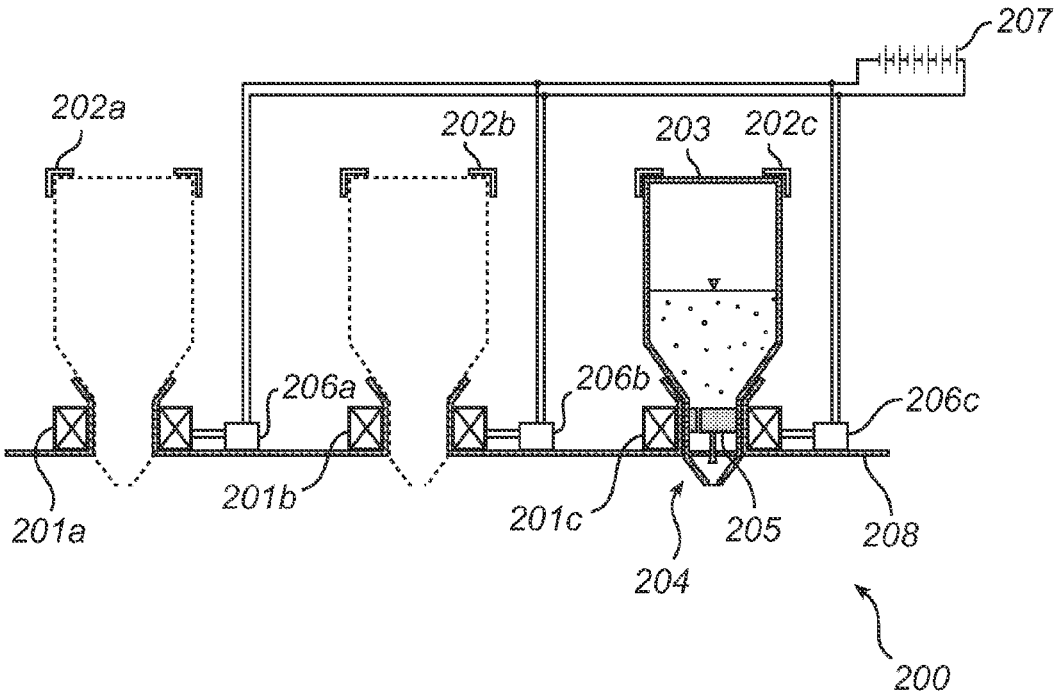
FIG. 2 shows a dispensing assembly according to an another embodiment of the present invention.

FIG. 2 shows an embodiment of the invention as a dispenser assembly 200 comprising holders 202 for several detachable liquid containers 203 having arranged in them pumps 204 operable in a contactless fashion by the action of a magnetic field. When a container 203 is retained by a holder 202, its pump 204 is in the region of an electromagnet 201 associated with the holder 202. The pump 204 comprises a magnetisable piston 205, as described above. Each electromagnet 201 is controlled by a control unit 206 for pulse-wise supplying the electromagnet 201 with electrical energy by pulses. The control unit 206 may also have a voltage boosting functionality as described above.

Advantageously, as shown in FIG. 2, all components in the dispenser assembly 200, including the detachable liquid containers 203, are arranged on one side of a barrier 208 having apertures allowing pumps 204 or liquid dispensed from pumps 204 to exit. The liquid containers 203 may be kept refrigerated in an economical manner if the barrier 208 is thermally insulating. However, by virtue of the portability of the assembly and its absence of electric mains connections, a user may equally well choose to store the whole assembly 200 in a refrigerated space.

Figure 3A:
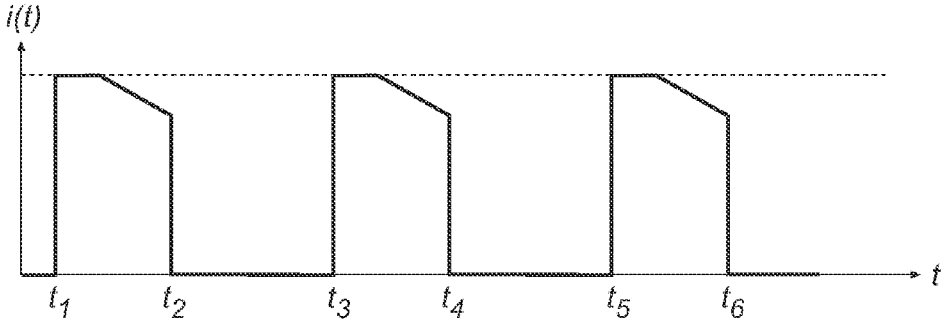
FIG. 3 shows the electromagnet current intensity as a function of time in different operational phases, and also illustrates a current measuring technique according to an embodiment of the invention.

FIG. 3A shows the a typical time behaviour of the current intensity in an electromagnet connected to a battery. Labels t1, t3 and t5 indicate points in time at which connection of the battery to the electromagnet takes place, and t2, t4, t6 are disconnection points. The pulses have constant length. As shown in the figure, the later part of each current pulse includes a decreasing portion resulting from battery fatigue. Thus, the charge amount of a pulse is less than the pulse duration multiplied by the initial current intensity. By a simple model, which ignores time-dependent effects, the initial current density is given by Ohm's law assuming the electromagnet to be a pure resistance and the battery to deliver its open-circuit voltage.

Figure 3B:
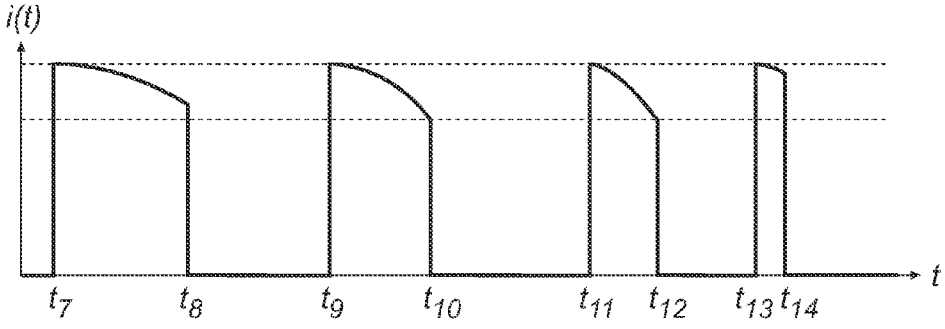

FIG. 3B shows a series of four current pulses obtained by application of particular control condition according to an embodiment of the present invention. The conditions are:

(i) If a pulse has lasted for a duration $T_{max}$, it is interrupted.

(ii) If the current intensity is below a minimum threshold current $I_{min}$, the pulse is interrupted.

(iii) If the total charge amount $Q_{tot}$ has been supplied, the pulse is interrupted.

The upper dashed horizontal line indicates the initial current supplied by the battery to the electromagnet. The lower dashed horizontal line indicates the minimum threshold current $I_{min}$. Applying these conditions, the first pulse, extending between points t7 and t8, has full duration $T_{max}$. The second pulse, between t9 and 10, is interrupted pertaining to condition (ii) because the current intensity sinks below the minimum threshold current. The third pulse, between t11 and t12, is also interrupted on the basis of this condition, only somewhat earlier as a result of battery fatigue. The interruption of the fourth pulse, between t13 and t14, is triggered by condition (iii), namely because the full charge amount, and hence the specified amount of liquid, has been supplied. If the battery had suffered from more pronounced ageing, the dosing device would have interrupted each pulse somewhat earlier under condition (ii), and the specified volume of liquid would have been supplied in a larger number of pulses. After fatigue has proceeded sufficiently far, the device will be inoperable by virtue of condition (iii) until the battery or batteries have been exchanged or recharged.

The exact number of pulses accomplished in order to dispense the specified volume depends on the pump size. Suitably, the dosing device has such dimensions that the number of pulses can be kept low so as to avoid early battery fatigue. Clearly, the pump size, battery (package) voltage and battery capacity are design matters to be considered jointly.

It is pointed out that the current pulses need not be equally separated in time, as shown for example in FIG. 3B.

Figure 3C:
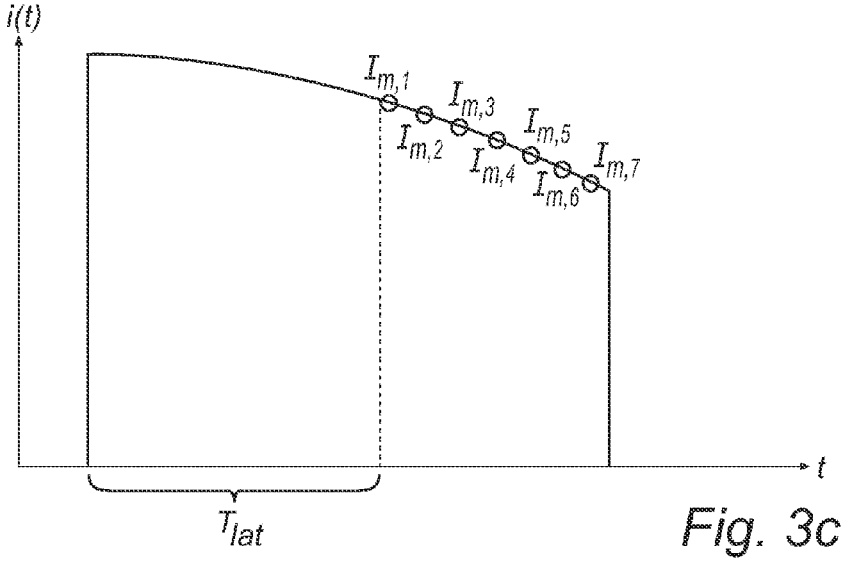

FIG. 3C illustrates a charge amount estimation technique according to an embodiment of the invention, by which the measurements (sampling) of momentary current intensity begin only after an initial latency period $T_{lat}$. This technique is advantageous because the initial portion of a current pulse does not differ much between pulses. In the initial portion, the current intensity may be constant over time and equal to the initial current intensity $I_0$. The current intensity may also decrease linearly, or may be approximated with good accuracy by a linearly decreasing function. In the example shown in FIG. 3C, the charge amount may be approximated as follows:

$$Q_m \approx T_{lat} I_0 + \Delta t\, I_{m,1} + \Delta t\, I_{m,2} + \ldots + \Delta t\, I_{m,7},$$

where Δt is the interval between current samples. The effect of systematic errors in this approximation may be mitigated by calibrating the proportionality constant K in the volume-to-charge relationship Q=K×V discussed above. In a finer approximation, the term representing the charge amount supplied during the latency period may be replaced by $$T_{lat} \frac{I_0 + I_{m,1}}{2},$$

which takes into account the current decrease occurring during the latency period.

Even though the present description and drawings disclose embodiments and examples, including selections of components, materials, volume ranges, current ranges, etc., the invention is not restricted to these specific examples. Numerous modifications and variations can be made without departing from the scope of the present invention, which is defined by the accompanying claims.

The invention claimed is:

1. A method of dispensing a specified volume ($V_{tot}$) of liquid using a pump comprising the steps of:

(i) defining a total charge amount ($Q_{tot}$) corresponding to the specified volume of liquid;

(ii) providing a pulse from a portable voltage source to an electromagnet, wherein the pulse energizes the electromagnet to displace a magnetisable pumping member of the pump;

(iii) measuring at least one current value ($I_{m,n}$) of the pulse;

(iv) estimating a supplied charge amount ($Q_m$) supplied to the electromagnet by the pulse, based on the at least one current value;

(v) determining an accumulated charge amount (Q), based on the supplied charge amount ($Q_m$); and (vi) repeating steps (ii), (iii), (iv), and (v) until the accumulated charge amount ($Q_m$) is greater than or equal to the total charge amount ($Q_{tot}$).

2. The method according to claim 1, wherein the pulse has a predefined maximum duration ($T_{max}$).

3. The method according to claim 2, further comprising the step of prematurely interrupting the pulse if the at least one current value is below a predefined minimum threshold current ($I_{min}$).

4. The method according to claim 2, further comprising the step of prematurely interrupting the pulse if the supplied charge amount ($Q_m$) is greater than or equal to a predefined maximum per-pulse charge amount ($Q_{max}$).

5. The method according to claim 1, wherein an interval between two consecutive pulses has a predefined minimum duration ($D_{min}$).

6. The method according to claim 1, wherein a linear numerical relationship is used in step (i) for defining the total charge amount.

7. The method according to claim 1, wherein step (iii) comprises performing a plurality of momentary current measurements beginning after an initial latency interval ($T_{lat}$).

8. A dosing device for dispensing a specified volume of liquid, wherein the dosing device comprises an electromagnet and a pump having a magnetisable pumping member, wherein the electromagnet, when energised, is configured to displace the magnetisable pumping member, and the magnetisable pumping member, when displaced, is configured to expel liquid from the pump, wherein the dosing device further comprises a portable voltage source configured to energise the electromagnet by repeated pulses and a control unit configured to measure a current value of the pulse at least once per pulse, estimate a supplied charge amount supplied to the electromagnet in each pulse based on the current value, determine an accumulated charge amount based on the charge amount supplied, and dispense liquid until the accumulated charge amount is greater than or equal to a total charge amount, wherein the total charge amount corresponds to the specified volume of liquid.

9. The dosing device according to claim 8, wherein the portable voltage source is configured to interrupt the pulse based on at least one of:

the duration of the pulse exceeding a predefined maximum duration;

the current of the pulse being below a predefined minimum threshold current;

the supplied charge amount in the pulse exceeding a predefined maximum per-pulse charge amount; or the accumulated charge amount exceeding the total charge amount.

10. The dosing device according to claim 8, wherein the portable voltage source comprises a battery.

11. The dosing device according to claim 8, wherein the portable voltage source is configured to separate two consecutive pulses by a predefined minimum duration.

12. The dosing device according to claim 8, wherein the total charge amount is based on a linear numerical relationship with the specified volume of liquid to be dispensed.

13. The dosing device according to claim 8, wherein the portable voltage source initiates a current measurement in a pulse after an initial latency interval.

14. The dosing device according to claim 8, wherein the dosing device is further configured to hold the pump, and wherein the pump comprises a biased, magnetisable pumping member.

15. A dispenser assembly, comprising at least one dispensing unit for dispensing a specified volume of liquid comprising:

an electromagnet; and a holder for receiving a liquid container comprising a pump having a magnetisable pumping member, displaceable under the action of the electromagnet and arranged in such a manner that a reciprocating displacement of the magnetisable pumping member causes liquid to be expelled from the pump, wherein the dispenser assembly further comprises a portable voltage source configured to energise the electromagnet in at least one of the dispensing units by repeated pulses and a control unit configured to measure a current value at least once per pulse, estimate a supplied charge amount supplied to the electromagnet in each pulse, determine an accumulated charge amount based on the supplied charge amount, and dispense liquid until the accumulated charge amount is greater than or equal to a total charge amount, wherein the total charge amount corresponds to the specified volume of liquid.

16. The method of dispensing a specified volume ($V_{tot}$) of liquid using a pump according to claim 1, further comprising the steps of defining another total charge amount corresponding to another specified volume of liquid, and repeating steps (ii), (iii), (iv), and (v) until the accumulated charge amount is greater than or equal to the other total charge amount.

* * * * *